US006624593B2

(12) United States Patent
Blanchard

(10) Patent No.: US 6,624,593 B2
(45) Date of Patent: Sep. 23, 2003

(54) DIMMABLE BALLAST FOR ELECTRODELESS FLUORESCENT LAMPS

(76) Inventor: Randall D. Blanchard, 12658 Futura St., San Diego, CA (US) 92130

( * ) Notice: Subject to any disclaimer, the term of this patent is extended or adjusted under 35 U.S.C. 154(b) by 0 days.

(21) Appl. No.: 09/974,126

(22) Filed: Oct. 8, 2001

(65) Prior Publication Data

US 2003/0067276 A1 Apr. 10, 2003

(51) Int. Cl.[7] ..... H05B 37/02

(52) U.S. Cl. ..... 315/209 R; 315/DIG. 4; 315/247; 315/246; 315/248

(58) Field of Search ..... 315/248, 247, 315/246, DIG. 4, 249, 289, 291, 209 R

(56) References Cited

U.S. PATENT DOCUMENTS 5,381,077 A * 1/1995 McGuire ..... 315/247
5,583,402 A * 12/1996 Moisin et al. ..... 315/307
5,932,976 A * 8/1999 Maheshwari et al. ..... 315/291
6,072,282 A * 6/2000 Adamson ..... 315/276
6,175,198 B1 * 1/2001 Nerone ..... 315/291
6,246,183 B1 * 6/2001 Buonavita ..... 315/248

* cited by examiner

*Primary Examiner*—Don Wong
*Assistant Examiner*—Tuyet T. Vo

(57) ABSTRACT

An apparatus for controlling the brightness of an electrodeless fluorescent lamp excited by power supplied to a coil disposed in closed proximity to said lamp. The apparatus includes a dimming control unit responsive to a brightness setting for the lamp that provides a PWM signal indicative of the brightness setting. An oscillator is disposed for producing a first lamp drive voltage having a first frequency selected in response to a first state of the PWM signal and a second lamp drive voltage having a second frequency selected in response to a second state of the PWM signal. Accordingly, the first drive voltage turns on the lamp by transferring maximum power to the lamp and the second drive voltage turns off the lamp by transferring minimum power to the lamp.

25 Claims, 4 Drawing Sheets

DIMMABLE BALLAST FOR ELECTRODELESS FLUORESCENT LAMPS

CROSS REFERENCE TO RELATED APPLICATION

This Application relates to U.S. patent application, Ser. No. 09/364,378, entitled LIQUID CRYSTAL DISPLAY DEVICE USING AN ELECTRODELESS LAMP, filed Jul. 30, 1999; and, to U.S. patent application, Ser. No. 09/974,125, entitled LOW PROFILE BACKLIGHT OPTIMIZED FOR LIQUID CRYSTAL DISPLAYS, filed on Oct. 8, 2001. Both Applications are incorporated herein by reference.

BACKGROUND OF THE INVENTION

1. Field of the Invention

The present invention generally relates to an apparatus for controlling and providing power to an electrodeless fluorescent lamp, and in particular to a fluorescent light ballast that will dim an unmodified electrodeless lamp across a very wide dimming range.

2. Description of Related Art

Liquid crystal materials emit no light of their own. They do however reflect and transmit light from external light sources. Liquid Crystal Displays ("LCD") are rapidly becoming the display material of choice for new, high-technology displays.

Accordingly, it is necessary to back light the LCD, which is typically done with fluorescent lamps located directly behind the LCD. When illuminated from behind, a white diffusion sheet between the backlight and the LCD redirects and scatters the light evenly to ensure a uniform display.

Fluorescent lights have a limited useful life and become dim over time. However, there is a new type of electrodeless fluorescent lamp available today that has a substantially longer life span than the electrode variety. Such lamps are manufactured and sold by Sylvania under the trade name ICETRON. These lamps are oval in shape and include a coil at each end for excitation thereof A method was developed for dimming such electrodeless lamps using a standard ballast. An additional winding was added to one core of the lamp. This prior art method operated by pulse width modulating a shorting switch across the winding of the drive coil. However, this prior art method has a limited dimming range of less than 100:1 and has poor efficiency.

Therefore, a need exists for an optimum dimming control for a fluorescent lamp operating in back lighting displays requiring up to a 10,000:1 brightness range.

SUMMARY OF THE INVENTION

Accordingly, a feature of the present invention is the provision of high intensity light source for use as a back light for LCD'S.

Another feature of the present invention is the provision of a dimmable light source operating with a 400 volt square wave at a resonant load frequency of 230 KHz.

Yet another feature of the present invention is the provision of a light source ballast that will switch the drive voltage between a normal operating frequency selected for maximum power transfer (i.e., maximum brightness) of the electrodeless lamp and a higher frequency selected for minimum power transfer (i.e., for black-out, or turn off condition). For a lamp designed to operate at 250 KHz, a preferred normal operating frequency is 260 KHz and a preferred non-operating frequency is 360 KHz.

Still another feature of the present invention is the use of pulse width modulation for changing the brightness of an electrodeless lamp by varying the time that a drive voltage is supplied at either of two distinctly different frequencies: one frequency turning the lamp on at maximum brightness and the other frequency turning the lamp completely off. A variety of digital and analog pulse width modulation (PWM) sources are readily available to provide a dimming control input. A feature of the present invention is the use of a synchronous digital dimming control.

These and other features, which will become apparent as the invention is described in detail below, are provided by an apparatus for controlling the brightness of an electrodeless fluorescent lamp excited by power supplied to a coil disposed in closed proximity to said lamp. The apparatus includes a dimming control unit responsive to a brightness setting for the lamp that provides a PWM signal indicative of the brightness setting. An oscillator is disposed for producing a first lamp drive voltage having a first frequency selected in response to a first state of the PWM signal and a second lamp drive voltage having a second frequency selected in response to a second state of the PWM signal. Accordingly, the first drive voltage turns on the lamp by transferring maximum power to the lamp and the second drive voltage turns off the lamp by transferring minimum power to the lamp.

Still other features and advantages of the present invention will become readily apparent to those skilled in the art from the following detailed description, wherein is shown and described only the preferred embodiment of the invention, simply by way of illustration of the best mode contemplated of carrying out the invention. As will be realized, the invention is capable of other and different embodiments, and its several details are capable of modifications in various obvious respects, all without departing from the invention. Accordingly, the drawings and description are to be regarded as illustrative in nature, and not as restrictive, and what is intended to be protected by Letters Patent is set forth in the appended claims. The present invention will become apparent when taken in conjunction with the following description and attached drawings, wherein like characters indicate like parts, and which drawings form a part of this application.

BRIEF DESCRIPTION OF THE DRAWINGS

The general purpose of this invention, as well as a preferred mode of use, its objects and advantages will best be understood by reference to the following detailed description of an illustrative embodiment with reference to the accompanying drawings in which like reference numerals designate like parts throughout the figures thereof, and wherein.

DETAILED DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the general principles of the present invention have been defined herein specifically to provide a fluorescent light ballast that will dim an unmodified electrodeless lamp across a very wide dimming range.

Figure 1:
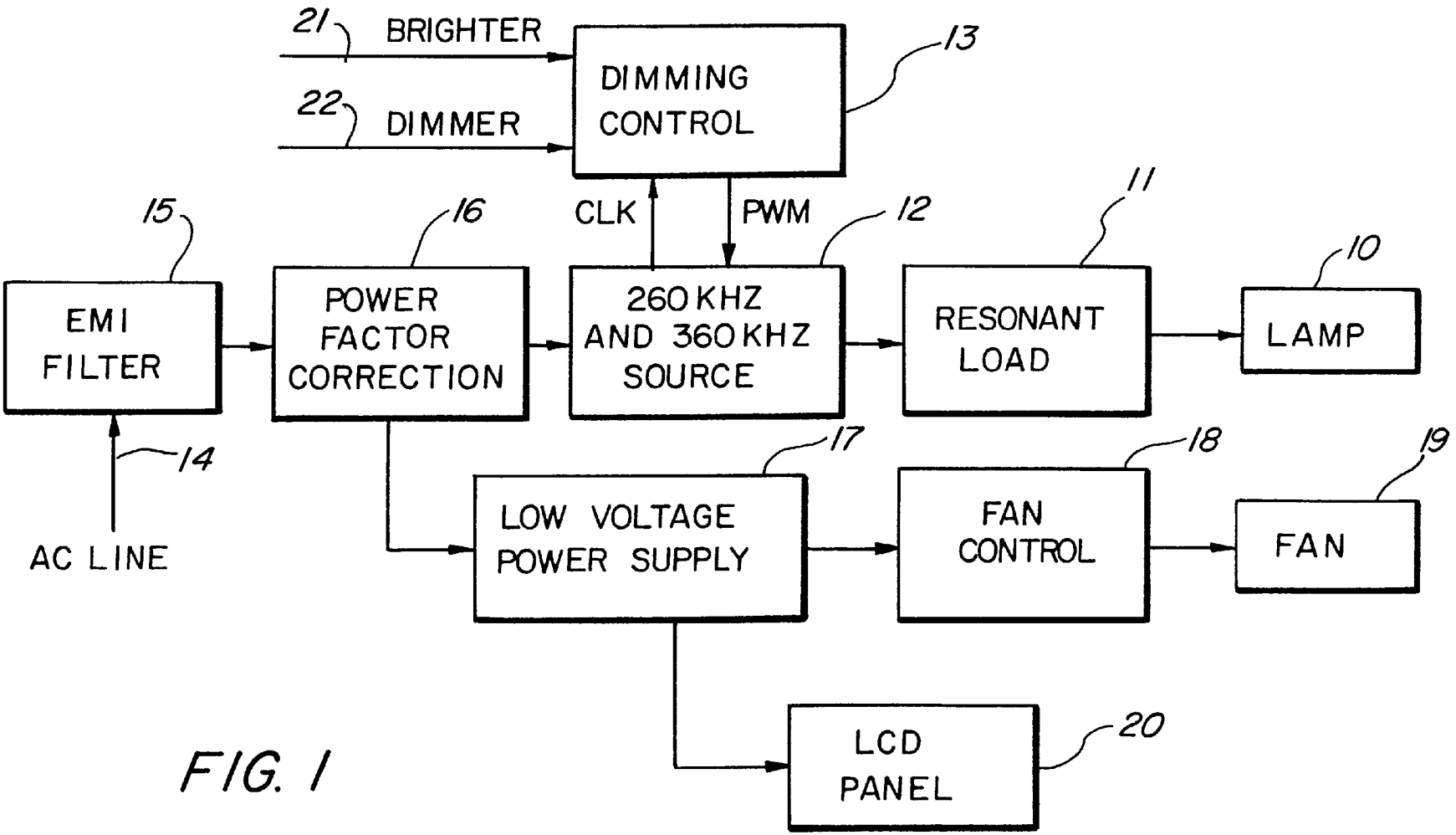
FIG. 1 illustrates a block diagram of the apparatus of the present invention.

Referring now to the drawings and FIG. 1 in particular, a block diagram of the apparatus of the present invention is shown. An electrodeless lamp 10 is driven from a resonant load 11, which is energized by a source 12, which is a current-controlled oscillator producing two discrete frequencies: 260 KHz and 360 KHz. A dimming control 13 switches between these two frequencies, wherein a 260 KHz signal turns the lamp "ON" to a maximum brightness and the 360 KHz signal turns the lamp completely "OFF". This will be explained and illustrated in greater detail hereinbelow.

Power is supplied to the source 12 from an AC line 14 via an Electromagnetic Interference (EMI) filter 15 and a power factor correction 16. The EMI filter 15 is used to minimize conducted line noise, while the power factor correction 16 is used to provide a power factor above 0.99. A nominal 400 volts DC output of the power factor correction 16 is supplied to a low-voltage power supply 17, which supplies power to a fan control 18 and a cooling fan 19 as well as an LCD panel 20 for the display itself.

The dimming control 13 is adjusted up or down by supplying a brighter signal on a line 21 or a dimmer signal on a line 22. As will be shown hereinafter, these are digital pulses that set a counter. A clock signal CLK is supplied to the dimming control 13 from the source 12, which clock signal CLK is used for synchronization as will be more fully described hereinafter. The output of the dimming control 13 is a signal referred to herein as PWM or Pulse Width Modulation, which signal selects between the two discrete frequencies driving the lamp 10. In particular, the PWM drives a current-controlled oscillator that produces one or the other of the two discrete frequencies for driving the lamp as a function of the state of the PWM signal. Such oscillators are well known in the art and will not be discussed further herein.

Figure 2:
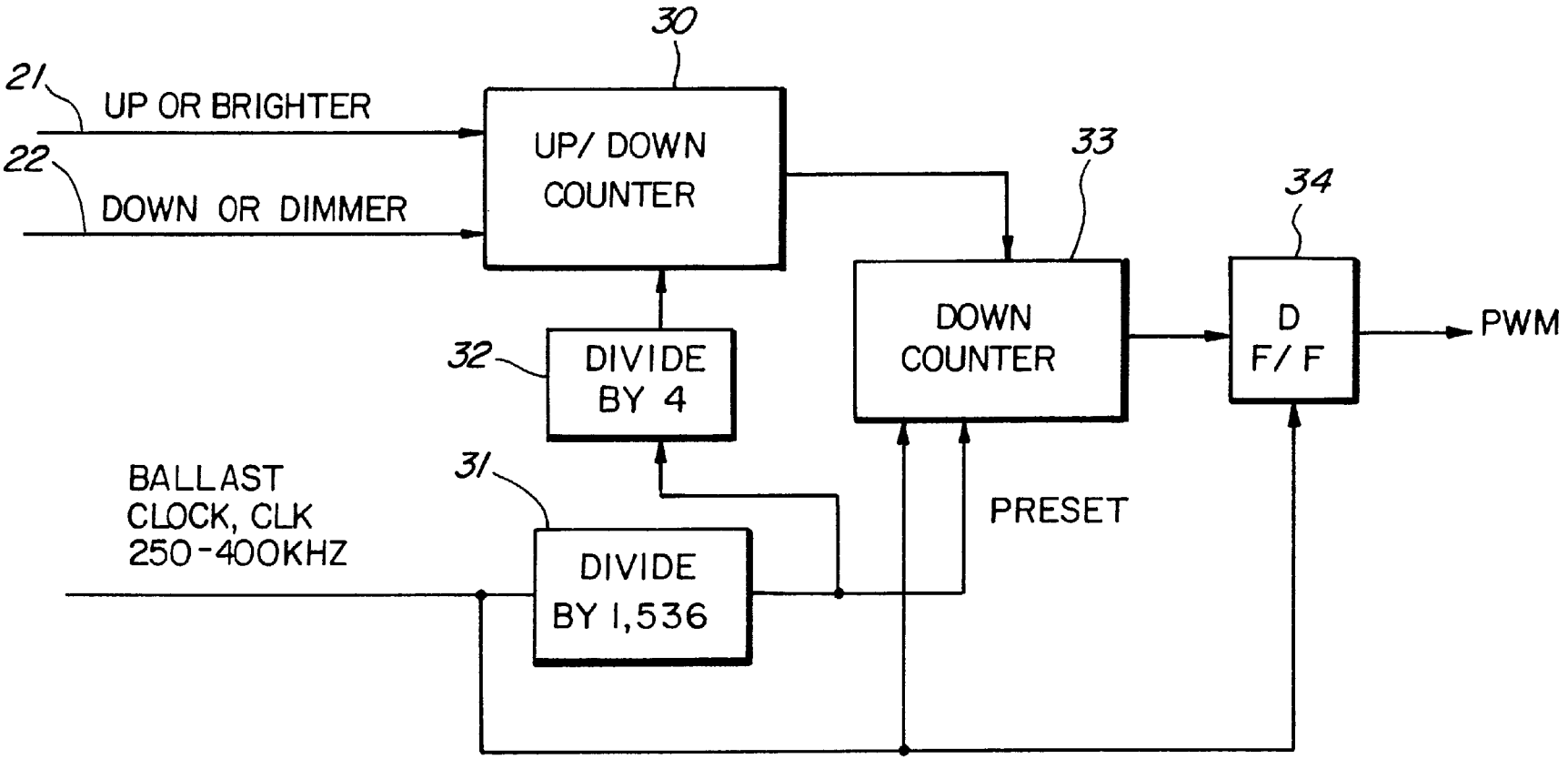
FIG. 2 illustrates a block diagram of the dimming control for the lamp.

Referring now to FIG. 2, details of the dimming control 13 and the source 12 are shown. The lines 21 and 22, which provide the brighter or dimmer digital pulses, are coupled to the set input terminals of an up/down counter 30. The CLK clock signal is supplied to an input of a divide by 1,536 block 31. This block 31 divides the CLK signal to define the PWM repetition rate and to produce a synchronization signal to a divide by 4 block 32, which in turn is supplied to the up/down counter 30 to define the rate of change of the counter 30. The output of the divide block 31 is also coupled to a down counter 33 as a preset input thereto. The down counter 33 is preset with the value of the up/down counter 30 in response to a preset signal from the divide block 31. The down counter 33 then counts down to zero at the Ballast Clock rate. The time for this countdown is the lamp "ON" time. The lamp is "OFF" until the next preset of the down counter 33.

The output of the down counter 33 is coupled to a D flip-flop 34, which is gated by the CLK signal. The output of the flip-flop 34 is the PWM signal supplied by the dimming control 13. As will be shown hereinafter, the CLK signal supplied to the flip-flop 34 gates the PWM output on the trailing edge transitions, which helps prevent flicker of the lamp. Moreover, this synchronization enables the brightness of the lamp to be controlled over an extremely broad range, e.g., 10,000:1. In other words, a dimming range of 10,000 to one.

Figure 3:
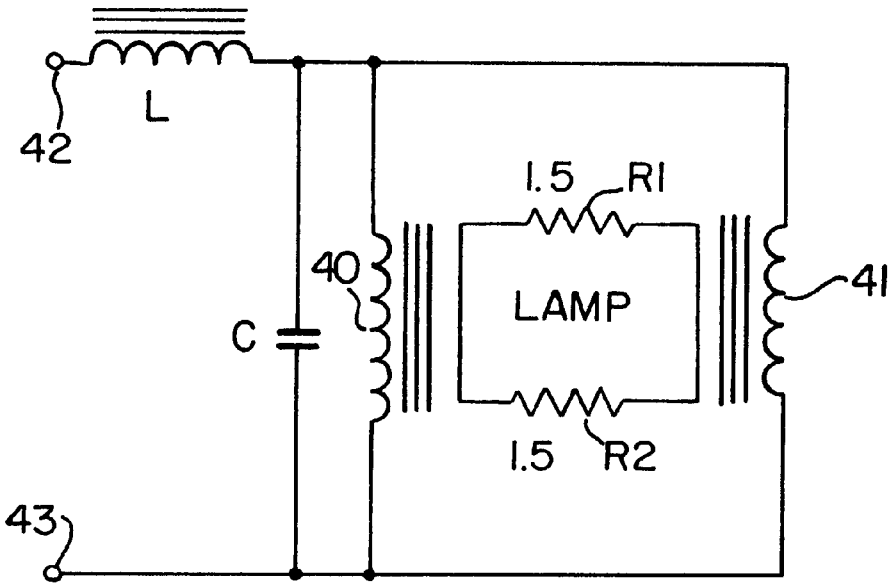
FIG. 3 is a schematic diagram of the equivalent circuit of the electrodeless lamp.

Referring now to FIG. 3, a schematic diagram showing the details of the resonant load 11 of FIG. 1 and the lamp 10 of FIG. 1 is shown. The resonant load 11 as shown in FIG. 3 includes a series inductor L and a capacitor C. Coils 40 and 41 are attached to each end of the electrodeless lamp for excitation thereof. The lamp itself reflects a series impedance of 3 ohms or 1.5 ohms per side as illustrated by resistors R1 and R2. Terminals 42 and 43 are disposed for receiving the drive signal from the source 12 (FIG. 1).

Figure 4:
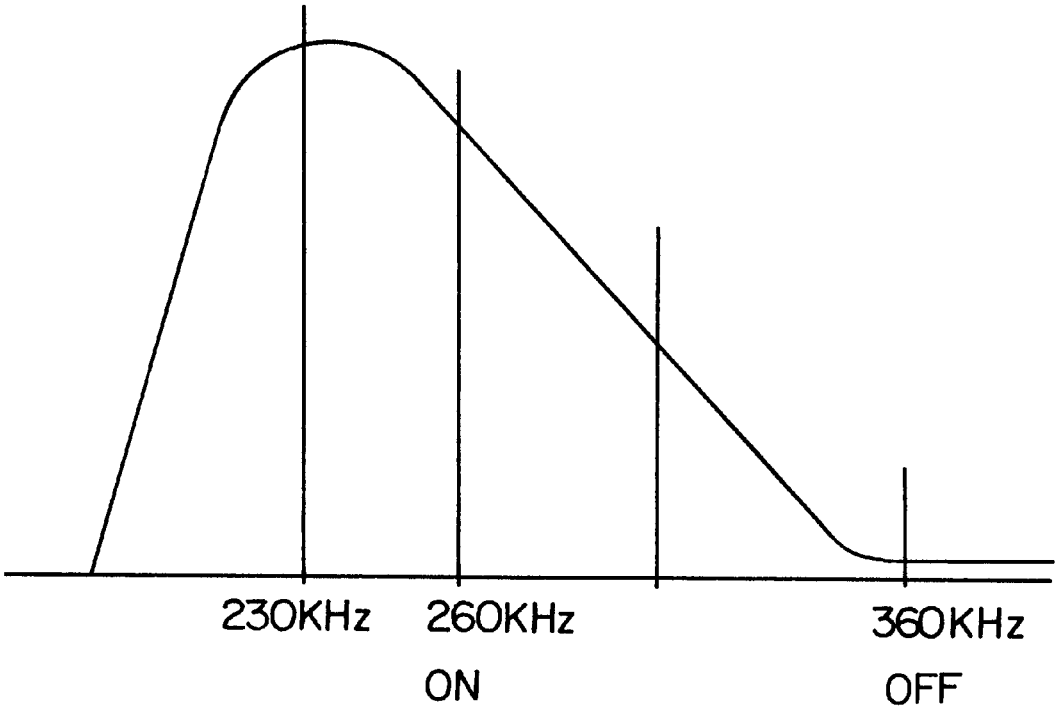
FIG. 4 is a frequency diagram showing the resonant point of the circuit shown in FIG. 3 and the points of maximum and minimum brightness of the electrodeless lamp.

FIG. 4 illustrates the voltage across the terminals 42 and 43 at frequencies of 230 KHz (resonant frequency), 260 KHz (lamp turn on point) and 360 KHz (lamp turn off point).

Figure 5:
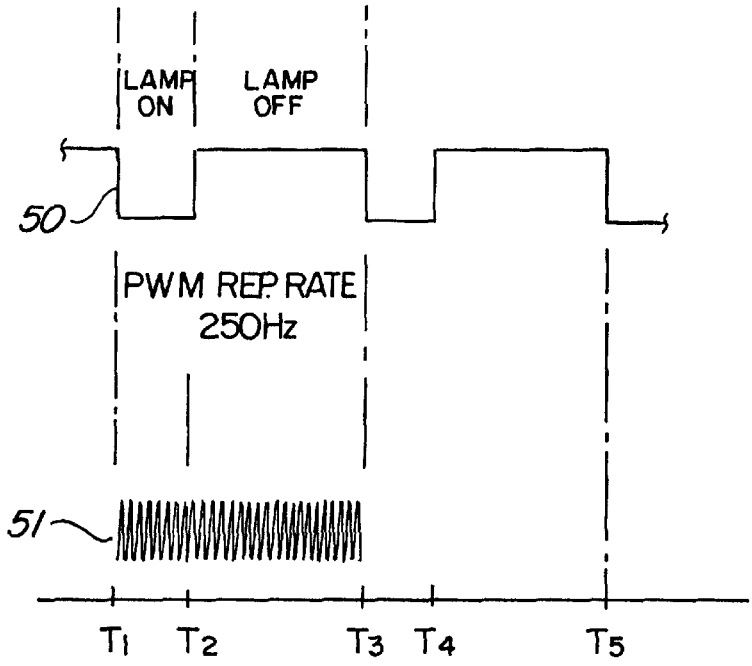
FIG. 5 is a timing diagram showing the pulse width modulation driving the electrodeless lamp in accordance with the present invention.

Referring now to FIG. 5, a timing diagram showing the pulse width modulation driving the electrodeless lamp in accordance with the present invention is shown. Waveform 50 illustrates the PWM signal generated by the dimming control 13 (FIG. 1). Waveform 51 illustrates the lamp voltage. Between the times T1 and T2 the lamp is on, as indicated by the low state of the waveform 50 and the 260 KHz signal of waveform 51. Between the times T2 and T3 the lamp is off, as indicated by the high level of the waveform 50 and the 360 KHz of waveform 51.

When the PWM is changed, i.e., the lamp on part of the waveform 50 is greater than the lamp off part of this waveform, the lamp becomes brighter because the percent of time that the 260 KHz signal is provided to the lamp is greater. Conversely, when the lamp on part of the waveform 50 is much less than the lamp off part of this waveform, the lamp becomes dimmer because the percent of time that the 360 KHz signal is provided to the lamp is greater. Accordingly, by changing the pulse width of the waveform 50 the lamp intensity can be changed.

Figure 6:
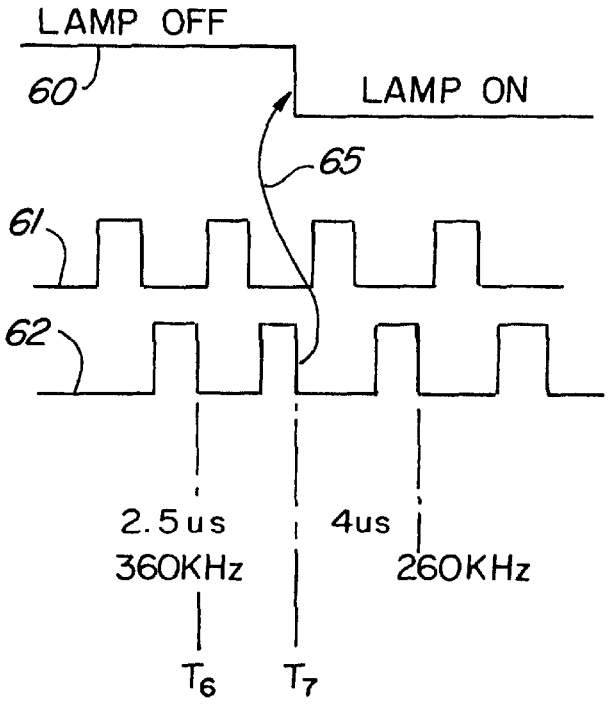
FIG. 6 is timing diagram showing the transition between turning the electrodeless lamp on and off.

Referring now to FIG. 6, a timing diagram showing the transition between turning the electrodeless lamp on and off is shown. Waveform 60 represents the PWM for purposes of this drawing, waveform 61 represents the low side of the half-bridge circuit generating the CLK signal and waveform 62 represents the high side of the same circuit. Note at time T7 the trailing edge of the waveform 62 triggers the transition from the lamp off state of the PWM (waveform 60) to the lamp on state of the PWM as shown by arrow 63. Note that it is necessary to maintain a stable amount of energy to the lamp in order to avoid flicker. This is accomplished by synchronizing the transition between frequencies to occur at the end of the half bridge low side transistor (i.e., transistor "ON" time). Arrow 65 shows the synchronization between the lamp "OFF" and "ON" time (waveform 60) to the low side of the half bridge circuit (waveform 62).

While the invention has been particularly shown and described with reference to a preferred embodiment, it will be understood by those skilled in the art that various changes in form and detail may be made therein without departing from the spirit and scope of the invention.

Those skilled in the art will appreciate that various adaptations and modifications of the just-described preferred embodiments can be configured without departing from the scope and spirit of the invention. Therefore, it is to be understood that within the scope of the appended claims, the invention may be practiced other than as specifically described herein.

What is claimed is:

1. An apparatus for controlling the brightness of an electrodeless lamp comprising:

a. a dimming control unit responsive to a brightness setting for said lamp and providing a PWM signal indicative of said brightness setting; and, b. an oscillator producing a first lamp drive voltage having a first frequency selected in response to a first state of said PWM signal and a second lamp drive voltage having a second frequency selected in response to a second state of said PWM signal, wherein said first drive voltage turns on said lamp and said second drive voltage turns off said lamp.

2. The apparatus as in claim 1 wherein said dimming control includes a digital counter being set by said brightness setting.

3. The apparatus as in claim 1 wherein said dimming PWM signal is synchronous with said lamp drive voltages.

4. The apparatus as in claim 1 wherein said oscillator is a current-controlled oscillator.

5. The apparatus as in claim 1 further including a power factor correction for providing a nominal 400 volt DC voltage source.

6. The apparatus as in claim 1 wherein said first frequency is 260 KHz.

7. The apparatus as in claim 1 wherein said first frequency is 360 KHz.

8. A circuit for controlling the brightness of an electrodeless lamp having a pair of coils for excitation thereof, said circuit comprising:

a. a PWM circuit for generating a PWM signal in response to a brightness setting; and b. a drive voltage circuit for generating a first lamp drive voltage having a frequency selected in response to a first state of said PWM signal and a second lamp drive voltage having a frequency selected in response to a second state of said PWM signal, wherein said first drive voltage turns on said lamp and said second drive voltage turns off said lamp.

9. The circuit of claim 8 wherein said PWM circuit for generating a PWM signal includes a digital counter being set by said brightness setting.

10. The circuit of claim 8 further including a synchronizing circuit to synchronize changes in said PWM with a defined position in said lamp drive voltages.

11. The circuit of claim 8 wherein said drive voltage circuit includes a current-controlled oscillator.

12. The circuit of claim 8 further including a power factor correction for providing a nominal 400 volt DC voltage source.

13. The circuit of claim 8 wherein said first frequency is 260 KHz.

14. The circuit of claim 8 wherein said frequency is 360 KHz.

15. An apparatus for controlling the brightness of an electrodeless fluorescent lamp excited by power supplied to a coil, said apparatus comprising:

a. a dimming control unit responsive to a brightness setting for said lamp and providing a PWM signal indicative of said brightness setting; and, b. an oscillator producing a first lamp drive voltage having a first frequency selected in response to a first state of said PWM signal and a second lamp drive voltage having a second frequency selected in response to a second state of said PWM signal, wherein said first drive voltage turns on said lamp by transferring maximum power to said lamp and said second drive voltage turns off said lamp by transferring minimum power to said lamp.

16. The apparatus as in claim 15 further including a resonant load including an inductor and a capacitor and inductive reactance generated by said coil exciting said lamp and an internal lamp resistance.

17. The apparatus as in claim 15 wherein said brightness setting produces a digital pulse signal for generating said PWM signal.

18. The apparatus as in claim 17 wherein the trailing edge of said digital pulse signal transitions said PWM signal, thereby substantially mitigating flicker of said lamp.

19. The apparatus as in claim 15 further including a power factor correction for providing a nominal 400 volt DC voltage source.

20. The apparatus as in claim 15 wherein said first frequency is 260 KHz.

21. The apparatus as in claim 15 wherein said first frequency is 360 KHz.

22. An apparatus for controlling the brightness of an electrodeless lamp comprising:

a pulsed voltage source for providing a pulsed voltage having a first and second frequency state for driving the electrodeless lamp; and a dimmer circuit for varying the width of the first and second frequency state of the pulsed voltage source;

whereby the lamp intensity becomes dimmer when the first frequency state of the pulsed voltage source is less than the second frequency state of the pulsed voltage source.

23. The apparatus of claim 22 wherein the pulsed voltage source comprises a lamp on frequency for the first state of the pulsed voltage source and a lamp off frequency for the second state of the pulsed voltage source.

24. The apparatus of claim 23 wherein the lamp on frequency is at about 260 KHz.

25. The apparatus of claim 23 wherein the lamp on frequency is at about 360 KHz.

* * * * *